US007442234B2

(12) United States Patent
Ilmasti

(10) Patent No.: US 7,442,234 B2
(45) Date of Patent: Oct. 28, 2008

(54) DEVICE AND METHOD FOR REMOVING UNDESIRABLE GASES AND PARTICLES FROM THE AIR

(76) Inventor: Veikko Ilmasti, Töllinmäki 10 a, Helsinki (FI) FI-00640

( * ) Notice: Subject to any disclaimer, the term of this patent is extended or adjusted under 35 U.S.C. 154(b) by 128 days.

(21) Appl. No.: 10/586,539

(22) PCT Filed: Mar. 21, 2005

(86) PCT No.: PCT/FI2005/000161

§ 371 (c)(1),
(2), (4) Date: Jul. 19, 2006

(87) PCT Pub. No.: WO2005/092510

PCT Pub. Date: Oct. 6, 2005

(65) Prior Publication Data

US 2007/0163434 A1 Jul. 19, 2007

(30) Foreign Application Priority Data

Mar. 29, 2004 (FI) ..... 20040466

(51) Int. Cl.
*B03C 3/014* (2006.01)

(52) U.S. Cl. ..... 96/27; 95/65; 95/71; 96/53; 96/97

(58) Field of Classification Search ..... 95/65, 95/71, 72; 96/27, 52, 53, 97
See application file for complete search history.

(56) References Cited

U.S. PATENT DOCUMENTS

| | | | | |
|---|---|---|---|---|
| 3,503,704 | A * | 3/1970 | Marks | 423/212 |
| 3,643,623 | A | 2/1972 | Eng et al. | |
| 3,765,154 | A * | 10/1973 | Hardt et al. | 96/88 |
| 4,072,477 | A * | 2/1978 | Hanson et al. | 95/71 |
| 4,141,698 | A | 2/1979 | Kihlstedt et al. | |
| 6,156,098 | A * | 12/2000 | Richards | 95/65 |
| 6,267,802 | B1 * | 7/2001 | Baldrey et al. | 95/58 |
| 6,656,253 | B2 * | 12/2003 | Willey et al. | 96/27 |
| 2002/0185004 | A1 * | 12/2002 | Willey et al. | 95/65 |
| 2004/0139853 | A1 * | 7/2004 | Bologa et al. | 95/64 |

FOREIGN PATENT DOCUMENTS

| | | |
|---|---|---|
| FI | 02/085524 A1 | 10/2002 |
| JP | 58088044 | 5/1983 |
| JP | 2003275291 | 9/2003 |

* cited by examiner

*Primary Examiner*—Richard L Chiesa
(74) *Attorney, Agent, or Firm*—Connolly Bove Lodge & Hutz LLP

(57) ABSTRACT

A device and a method for removing undesirable gases and particles from the air are provided. The device includes a purifying chamber through which air (1) to be purified is arranged to pass and has an entrance end provided with a zone (2) producing water dust. The purifying chamber is provided with ionemitting tips (3) operating by high voltage current and with collecting surfaces (4) collecting impurities from the air. The zone (2) is provided with dies (7) producing water dust having a droplet size of 20 to 40 μm, and the collecting surfaces (4) are grounded. The ion emitting tips (3) are directed toward the collecting surfaces (4) and generate ion jets rushing from the ion emitting tips (3) causing water dust and gases and particulate materials attached to the droplets of said dust to be forced against said collecting surfaces (4).

4 Claims, 1 Drawing Sheet

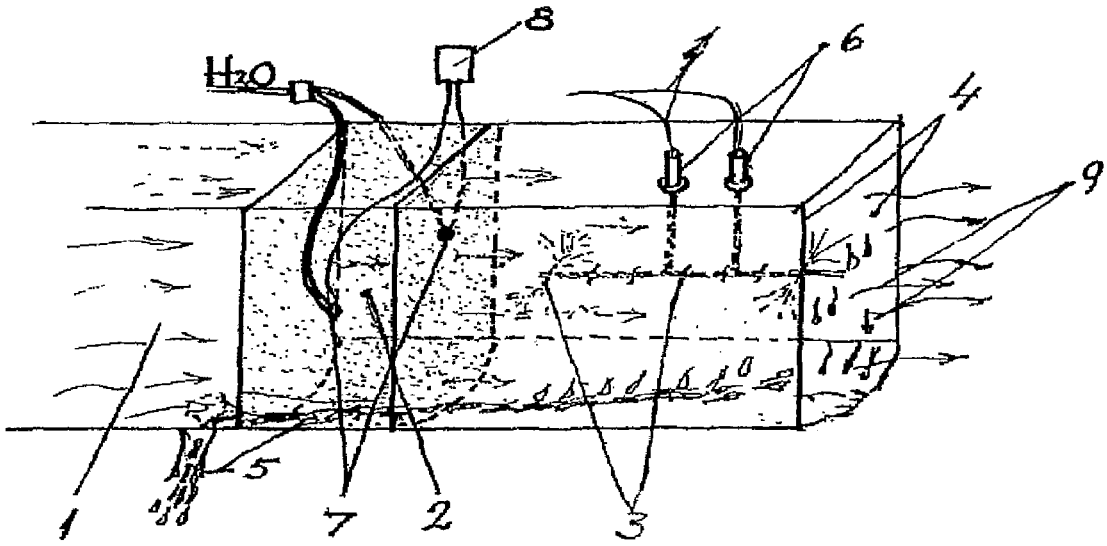
8
$H_2O$
6
4
9
5
1
7
2
3

DEVICE AND METHOD FOR REMOVING UNDESIRABLE GASES AND PARTICLES FROM THE AIR

This application is a National Stage of PCTIFI2005/000161 filed Mar. 21, 2005 which in turn claims priority from Finnish Application 20040466, filed Mar. 29, 2004.

This invention refers to a device for removing undesirable gases and particles from the air, which device comprises a purifying chamber through which air to be purified is arranged to pass and having an entrance end provided with a zone producing water dust, said purifying chamber being provided with ion emitting tips operating by high voltage current and with collecting surfaces collecting impurities from the air.

This type of air purifying device, known per se are known from many Finnish and U.S. patents. Air passing through the air-purifying device is subjected to an ion blast, whereby particles in the air will be forced against and attached to the collecting surface. The collecting surfaces are purified at intervals by means of water jets or a mechanical vibrator device. Practice and experiments have shown that this kind of devices will purify even particles of nano size.

The object of this invention is to further develop said air-purifying device. This is achieved with a device, which is characterized in that said zone is provided with dies producing water dust having a droplet size of 20 to 40 μm, and that said collecting surfaces are grounded and that the ion emitting tips are directed towards said collecting surfaces and generate ion jets rushing from the ion emitting tips causing water dust and gases and particulate materials attached to the droplets of said dust to be forced against said collecting surfaces.

Further features of the device according to the invention are presented in the enclosed dependent claims.

The invention also refers to a method for purifying air, wherein air is purified by means of ion blast provided by high voltage current. The method according to the invention is characterized in that water dust or steam is sprayed into air to be purified before the air to be purified is led to the ion blast.

Experiments have shown that odours can effectively be removed from air to be purified by means of the device and the method according to the invention. In the same way nano sized and larger particles can be removed from the air.

The invention is described in the following by means of an example with reference to the enclosed drawing showing schematically an embodiment of an air-purifying device according to the invention.

The air-purifying device comprises a purifying chamber into which air to be purified 1 is led. In an entrance end of the purifying chamber there is a water dust zone 2 formed by water dust dies 7, through which zone air to be purified is arranged to flow before it enters the purifying space proper having ion emitting tips 3 operating by means of high voltage current, which tips are directed towards collecting surfaces 4 of the purifying chamber, to which surfaces water dust and gas and particles attached to the droplets of said dust is thrown at the influence of ion jets rushing from the ion emitting tips 3. The high voltage current led to the ion emitting tips via an insulator 6 can be at a range of 5 to 150 kV. The collecting surfaces 4 can be a grounded frame of the device or a grounded receiving surface. The water dust generated in the water dust zone 2 has preferably a droplet size of 20 to 40 μm, which droplets are preferably generated by an ultrasound oscillator 8, from which they are led through the water dust dies 7 to said water dust zone 2. The purified air leaves the purifying chamber through the exit end thereof. At the bottom of the purifying chamber there is an outlet channel 5 for conveying gases and particles separated from the air together with water formed from the water dust towards the entrance end of the purifying chamber.

The droplets of water dust can alternatively be produced by compressor-pressurized air.

Experiments have shown that odorous particles in the air are bound to the water droplets, which due to the ion blast are collected to the collecting surfaces 4. When enough water and particles of dirt and odours are collected to the collecting surfaces, said water and particles will flow down to the outlet channel 5 at the bottom part or at the bottom of the purifying chamber and out through the entrance end of purifying chamber.

The invention claimed is:

1. A device for removing undesirable gases and particles from the air, wherein the device comprises a purifying chamber through which air to be purified is arranged to pass and having an entrance end provided with a zone producing water dust, wherein said purifying chamber being provided with ion emitting tips operating by high voltage current at a range of 5 to 150 kV and with collecting surfaces collecting impurities from the air, wherein said zone is provided with dies producing water dust having a droplet size of 20 to 40 μm, and that said collecting surfaces are grounded and that the ion emitting tips are directed towards said collecting surfaces and generate ion jets rushing from the ion emitting tips causing water dust and gases and particulate materials attached to the droplets of said dust to be forced against said collecting surfaces.

2. The device according to claim 1, wherein there is an outlet chamber at the bottom of the purifying chamber for conveying gases and particles separated from the air together with water formed from the water dust away through the entrance end of the purifying chamber.

3. The device according to claim 2, wherein water dust is produced by means of an ultrasound-oscillator.

4. The device according to claim 2, wherein water dust is produced with compressor-pressurized air.

* * * * *